United States Patent [19]

Höfer

[11] 4,444,170

[45] Apr. 24, 1984

[54] FUEL INJECTION PUMP FOR INTERNAL COMBUSTION ENGINES

[75] Inventor: Gerald Höfer, Weissach, Fed. Rep. of Germany

[73] Assignee: Robert Bosch GmbH, Stuttgart, Fed. Rep. of Germany

[21] Appl. No.: 409,419

[22] Filed: Aug. 19, 1982

[30] Foreign Application Priority Data

Oct. 7, 1981 [DE] Fed. Rep. of Germany ..... 3139789

[51] Int. Cl.[3] ..... F02D 7/00

[52] U.S. Cl. ..... 123/382; 123/380; 123/387

[58] Field of Search ..... 123/382, 383, 387, 385, 123/386, 380

[56] References Cited

U.S. PATENT DOCUMENTS

| | | | |
|---|---|---|---|
| 288,980 | 5/1943 | Biechl | 123/385 |
| 2,139,981 | 12/1938 | Sugihara | 123/385 |
| 3,004,531 | 10/1961 | Udale | 123/382 |
| 3,077,873 | 2/1963 | Parks et al. | 123/382 |
| 3,795,233 | 3/1974 | Crews et al. | 123/383 |
| 4,037,575 | 7/1977 | Sommars | 123/367 |
| 4,136,656 | 1/1979 | Sokolov et al. | 123/383 |

FOREIGN PATENT DOCUMENTS

| | | | |
|---|---|---|---|
| 56-41429 | 4/1981 | Japan | 123/383 |

*Primary Examiner*—Ira S. Lazarus
*Assistant Examiner*—Magdalen Moy
*Attorney, Agent, or Firm*—Edwin E. Greigg

[57] ABSTRACT

A fuel injection pump, the volume adjustment member of which has a limiter of its play in the form of an adjustable device, which is movable in accordance with the displacement of a control piston in response to a contour provided in the control piston. The displacement of the first control piston occurs in accordance with the pressure of the air supplied to the combustion chambers of the internal combustion engine, and this in turn is controlled with the aid of a pressure element. The pressure element actuates a control piston, with the aid of which a control pressure is created which actuates the first control piston. The control pressure, at the same time, acts on the pressure element by way of the second control piston in the form of return pressure. In a state of equilibrium the control pressure circuit is separated from the pressure source.

4 Claims, 2 Drawing Figures

FUEL INJECTION PUMP FOR INTERNAL COMBUSTION ENGINES

BACKGROUND OF THE INVENTION

The invention relates to a fuel injection pump for internal combustion engines. In such a fuel injection pump, known from U.S. Pat. No. 4,037,575, the pressure chamber, enclosed by the control pressure piston, is constantly connected with the pressure source by means of a throttle and thus is arranged to control with its front edge the connective diameter to a relief channel. This device has the disadvantage that, whatever pressure is selected in the pressure chamber, a more or less large amount of pressure fluid constantly flows off toward the relief side. This necessitates a powerful fuel supply pump for the fuel injection pump and an increased use of energy.

OBJECT AND SUMMARY OF THE INVENTION

The fuel injection pump of the present invention, as revealed hereinafter, has the advantage that, as long as the control pressure does not have to be changed no fuel is used for the creation of control pressure. Should the density of the air supplied to the combustion chamber of the internal combustion engine change, the hydraulic fluid necessary for the increase of the control pressure and the adjustment of the control piston can be supplied very rapidly to the pressure chamber and the succeeding system. Conversely, under the opposite conditions a reduced control pressure can be selected very rapidly by opening the relief channel. The diameters of the openings do not have to conform to the dynamics of the reduced supply of pressure fluid to the pressure chamber as is the case in the state of the art. A quickly reacting adjustment of the stop for the volume adjustment member, having low friction and low hysteresis, is thereby achieved.

The invention will be better understood and further objects and advantages thereof will become more apparent from the ensuing detailed description of preferred embodiments taken in conjunction with the drawings.

BRIEF DESCRIPTION OF THE DRAWINGS

Two exemplary embodiments of the present invention are shown in the drawing and are further explained in the following description.

DESCRIPTION OF THE PREFERRED EMBODIMENTS

Figure 1:
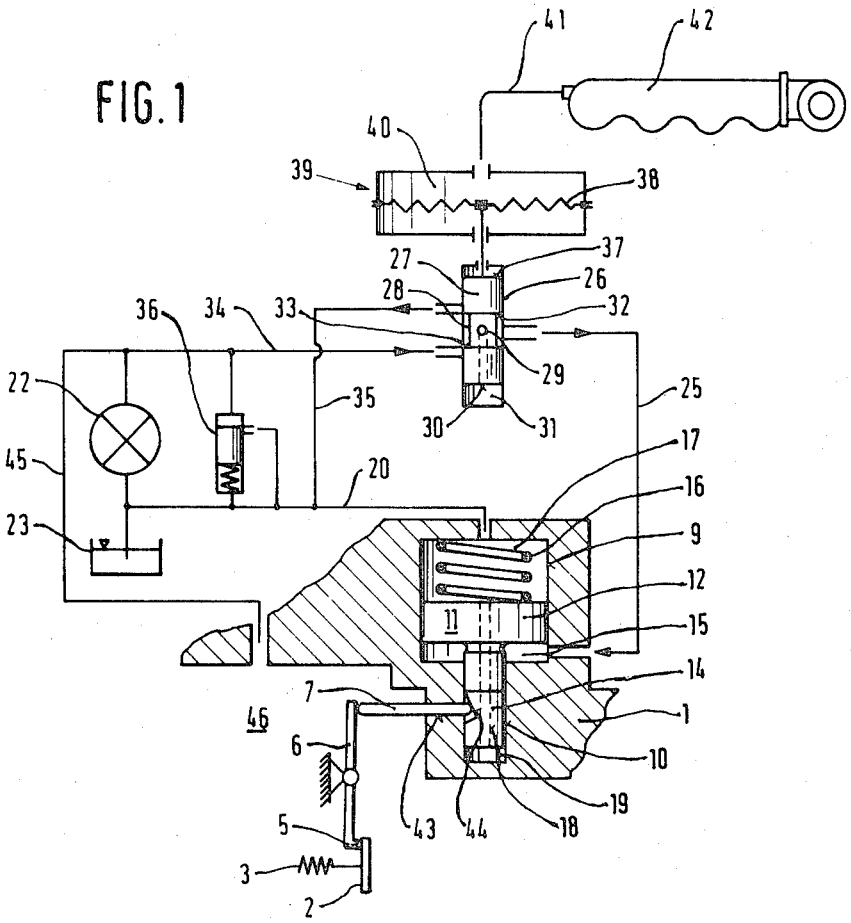
FIG. 1 shows, in a schematic view, a device for the adjustment of the full-load stop of a volume adjustment member of a fuel injection pump in accordance with the present invention.

In FIG. 1 a part of a fuel injection pump is shown, which could, for instance, be a distributor injection pump. It shows in a known manner a fuel volume adjustment member 2, developed in the form of a lever, which actuates a revolving slide plate (not further described) for the regulation of the fuel injection amount. The fuel volume adjustment member 2, adjustable against a control spring device 3, touches an adjustable stop 5 when in the full load position, which in the exemplary embodiment is placed at the end of a rocker 6, the other end of which touches a scanning pin 7.

A step bore is disposed in the housing 1 of the fuel injection pump, which consists of a first bore 9 with a large diameter and an adjacent coaxial second bore 10 with a smaller diameter. In this step bore arrangement a first control piston 11 is disposed in a closely movable fashion, having a first piston part 12 with a diameter corresponding to the first bore 9 and a second piston part 14 with a diameter corresponding to the second bore 10. The first piston part 12 encloses in the first bore 9 a ring-shaped work space 15 and is loaded with a pressure spring 16 on its front face which is spaced away from the work space 15. The space 17 containing this spring is connected, by way of an axial bore 18 in piston parts 12 and 14, with the front face of the second piston part 14 and the space 19 enclosed by the second piston in the second bore 10. Further, the space 17 is connected by way of a drainage tube 20 with the suction side of a fuel supply pump 22 or with the fuel tank 23.

From the work space 15 a control pressure line 25 leads to a cylinder 26, in which a second control piston 27 is disposed in a closely movable fashion. This second control piston 27 has an annular tee-slot 28, from which a bore 29 leads through the second control piston to its frontal side 30. The latter encloses a pressure chamber 31 in cylinder 26.

Both front border areas of the annular tee-slot form a first control edge 32 and a second control edge 33. In a centered position of the second control piston 27, the piston parts adjacent to the control edges are adapted to just close a pressure line 34, leading into cylinder 26, and a relief line 35, leading away from the cylinder 26. The smallest displacement of the control piston, depending on the direction of the displacement, leads to an opening of one or the other of these lines. The first control edge 32 is assigned to the relief line 35 and the second control edge 33 is assigned to the pressure line 34. The pressure line is supplied with fuel pressure by the fuel supply pump 22, and the fuel pressure is regulated in a known manner by a pressure control valve 36. The relief line 35, together with the drainage tube 20, leads to the suction side of the fuel supply pump 22 or to the fuel tank. The control pressure line 25, not closable by the control edges 32, 33, empties into the cylinder 26 in the area of the annular tee-slot, which, as shown in FIG. 1, is in a centered position.

The second control piston 27 is furthermore connected on its other face 37 with the membrane 38 of the pressure element 39 by use of any suitable rod. The membrane contains inside the pressure element a control pressure chamber 40, which is connected, by way of a control line 41, with the suction system 42 of the internal combustion engine served by the fuel injection pump. The other side of the membrane 38 is subjected to atmospheric pressure as is believed to be clear from the drawing.

The connection between the adjustable stop 5 and the first control piston 11 is made by way of the rocker 6 or the scanning pin 7 in such a way that the scanning pin 7 extends through a guide bore 43 in the housing 1 into the second bore 10 of the step bore and there touches against the body surface of the second piston part 14 of the first control piston 11. The second piston part 14 is provided with a predetermined contour 44 in the area of the scanning pin 7, so that, when the first control piston is displaced, the scanning pin is also displaced following this contour. This displacement is transferred by way of the rocker to the adjustable stop 5.

The fuel injection pump described works as follows: At the start-up of the fuel injection pump, the fuel supply pump supplies fuel through the pressure line 34 as well as through a fuel supply line 45 to the pump suction chamber of the fuel injection pump as shown. In the case where the amount of fuel injected is to be adapted to the load pressure of the internal combustion engine operated by the fuel injection pump, insufficient pressure is available at the start-up in the suction system 42, so that the second control piston 27 is brought into a predetermined position by the membrane 38, on which atmospheric pressure acts, whereby the relief line 35 is opened by the first control edge 32. Correspondingly, a connection by way of the control pressure line 25 leading from the cylinder 26 in the area of the annular tee-shot 28 between the annular work space 15 and the relief side is opened. By the reaction of the pressure spring 16 the first control piston 11 is displaced into one of its extreme positions. The pressure chamber 31, too, in the cylinder 26 is relieved by way of the bore 29 towards the relief line 35. The contour 44 has, in the extreme position of the first control piston 11 described above, the least divergence from the cylindrical surface of the piston part 14 in the scanning area, so that the scanning pin 7 is fully extended and the adjustable stop 5 is displaced in the direction of a minimal full injection amount.

When the load pressue increases, however, the second control piston 27 is displaced downwardly, the relief line 35 is closed by the first control edge 32 and the pressure line 34 is opened by the second control edge 33. Now fuel flows into the annular tee-slot 28 and the pressure chamber 31. Furthermore, fuel flows by way of the control pressure line 25 into the annular work space 15. Since this creates a pressure in the pressure chamber 31, the second control piston 27 is moved in a reverse manner. This slowly closes the supply through the fully opened pressure line 34 and shuts it off completely when the second control piston 27 is in equilibrium. The amount of fuel contained in the cylinder 26, the control pressure line 25 and the annular work space 15 is maintained from this moment on. Through the increase in pressure, the first control piston 11 has in the meantime also been moved against the force of the pressure spring 16. The scanning pin 7 has followed the contour 44 and has displaced the adjustable stop 5 in the direction of greater full load injection amounts. The contour has been adapted to the specific needs of the particular internal combustion engine.

Figure 2:
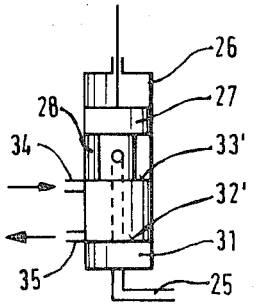
FIG. 2 shows an equivalent development of the control piston.

An equivalent development in the second control piston 27 is shown in FIG. 2. The second control piston 27, in this embodiment, has generally the same shape, only the lower piston area is somewhat larger. The control pressure line 25 branches off, in this embodiment, from the bottom of the cylinder 26, which delimits the pressure chamber 31, and the opening of the pressure line 34 and the exit of the relief line 35 are placed in such a way in this exemplary embodiment, that the first control edge 32' is constituted by the front side of the second control piston 27 which delimits the pressure chamber 31, and that the second control edge 33', which controls the pressure line is constituted by the frontal border area of the annular tee-slot 28.

Instead of the pressure element 39 shown in FIG. 1, which contains the pressure of the suction system of the internal combustion engine, it is, of course, also possible to provide an absolute pressure element, which controls the second control piston 27 according to the atmospheric pressure.

The foregoing relates to preferred exemplary embodiments of the invention, it being understood that other embodiments and variants thereof are possible within the spirit and scope of the invention, the latter being defined in the appended claims.

What is claimed and desired to be secured by Letters Patent of the United States is:

1. A fuel injection pump for internal combustion engines including combustion chambers, said fuel injection pump including a fuel injection quantity adjustment member and an associated device for the adjustment of the adjustment member, an adjustment device having a first control piston adjustable against an adjustable control spring and arranged to be placed under varying control pressures, whereby movement of the injection quantity adjustment member is adjustable, said pump further including a control device for changing the control pressure, said control device including a second control piston having at least a frontal side, means for operating said second piston in response to a force generated by the density of air supplied to the combustion chambers of the internal combustion engine, and by a control pressure which is disposed in a cylinder, and said second control piston further arranged to delimit with said frontal side a pressure chamber, which is connected by way of a constantly open control pressure line with a work space of said first control piston, said second control piston has first and second control edges, said first control edge controls only a pressure line leading from a pressure source into said pressure chamber and said second control edge controls only a relief line leading from said pressure chamber to a return line, said second control piston having one position at which said first and second control edges close said pressure line and said relief line leading to said second piston.

2. A fuel injection pump according to claim 1, wherein said means for operating said second control piston in response to a force generated by the density of air supplied to the combustion chambers comprises a pressure element connected to said second control piston wherein said pressure element is subjected to the pressure of the air supplied to the combustion chambers of the internal combustion engine as well as to a reference pressure, and further wherein said second control piston has an annular groove which is permanently connected by way of a bore with said pressure chamber enclosed by said frontal side of said second control piston.

3. A fuel injection pump according to claim 1, wherein said movement of said injection quantity adjustment member can be limited by an adjustable stop which is actuated by said first control piston.

4. A fuel injection pump according to claim 3, wherein said first control piston has a contour and that said contour is scanned by a device coupled with said ajustable device.

* * * * *